US005983580A

United States Patent [19]

Carr

[11] Patent Number: 5,983,580

[45] Date of Patent: Nov. 16, 1999

[54] STAIR FRAME

[76] Inventor: M. Robert Carr, HCR 66, Box 91A, Prairie City, S. Dak. 57649

[21] Appl. No.: 09/055,845

[22] Filed: Apr. 6, 1998

[51] Int. Cl.[6] ..... E04F 11/00

[52] U.S. Cl. ..... 52/187; 52/182; 52/183

[58] Field of Search ..... 52/187, 182, 183

[56] References Cited

U.S. PATENT DOCUMENTS

| | | | |
|---|---|---|---|
| D. 271,524 | 11/1983 | Suckno . | |
| D. 282,103 | 1/1986 | Gregoire . | |
| D. 288,720 | 3/1987 | Gould . | |
| 853,134 | 5/1907 | Steiber | 52/182 |
| 1,087,434 | 2/1914 | Bone | 52/183 |
| 2,704,383 | 3/1955 | Berg | 20/1.126 |
| 3,230,907 | 1/1966 | Morford et al. | 108/50 |
| 3,556,251 | 1/1971 | Whitehead . | |
| 3,626,438 | 12/1971 | Cornell | 52/183 |
| 3,686,806 | 8/1972 | Verderio . | |
| 3,885,365 | 5/1975 | Cox | 52/183 |
| 3,962,838 | 6/1976 | Cox | 52/183 |
| 4,041,662 | 8/1977 | Ward . | |
| 4,128,976 | 12/1978 | Classen . | |
| 4,338,751 | 7/1982 | Sanders . | |
| 4,378,862 | 4/1983 | Carmel | 182/106 |
| 4,438,608 | 3/1984 | Hamm . | |
| 4,457,398 | 7/1984 | Loix | 182/151 |
| 4,660,335 | 4/1987 | Scholler . | |
| 4,881,351 | 11/1989 | Hamm . | |
| 5,502,933 | 4/1996 | Skillern | 52/182 |
| 5,515,657 | 5/1996 | Chou . | |
| 5,632,124 | 5/1997 | Weingarten et al. . | |
| 5,660,009 | 8/1997 | Cousin . | |

*Primary Examiner*—Christopher T. Kent
*Assistant Examiner*—Nkeisha J. Maddox
*Attorney, Agent, or Firm*—Zarley, McKee, Thomte Voorhees & Sease; Dennis L. Thomte

[57] ABSTRACT

A stair frame may be used to form a straight staircase, a spiral staircase, or a combination of the two. The stair frame includes an elongated angle having a leg and a back, the back cut into a plurality of independent back portions and the leg bent into a zigzag shape with alternating vertical and horizontal leg portions. A rail is fastened to the upper end of each vertical portion back and the forward end of each horizontal portion back to secure the angle into a sturdy frame which may be bent into a helical pattern. The horizontal leg portions serve the dual purpose of forming sturdy frame, and supporting one end of the staircase treads.

15 Claims, 5 Drawing Sheets

STAIR FRAME

TECHNICAL FIELD

The present invention relates generally to staircases, and more particularly to an improved frame for supporting stair treads which may be oriented in either a straight or spiral configuration, or a combination of the two.

BACKGROUND OF THE INVENTION

Conventionally, spiral and circular staircases are custom built by skilled carpenters, in order to produce the appropriate curvature and rise in the stringers which support the stair treads. This is especially true where the staircase involves a combination of a curved portion and a straight portion, or curved portions of different radii.

SUMMARY OF THE INVENTION

It is therefore a general object of the present invention to provide an improved frame for use as a stringer on a staircase which may be oriented either straight or curved, or a combination of the two.

Another object is to provide an improved stair frame which is simple to construct and easy to use.

Still a further object of the present invention is to provide an improved stair frame which does not require skilled craftsmen to make and use.

These and other objects of the present invention will be apparent to those skilled in the art.

The stair frame of the present invention may be used to form a straight staircase, a spiral staircase, or a combination of the two. The stair frame includes an elongated angle having a leg and a back, the back cut into a plurality of independent back portions and the leg bent into a zigzag shape with alternating vertical and horizontal leg portions. A rail is fastened to the upper end of each vertical portion back and the forward end of each horizontal portion back to secure the angle into a sturdy frame which may be bent into a helical pattern. The horizontal leg portions serve the dual purpose of forming sturdy frame, and supporting one end of the staircase treads.

DESCRIPTION OF THE PREFERRED EMBODIMENT

Figure 1:
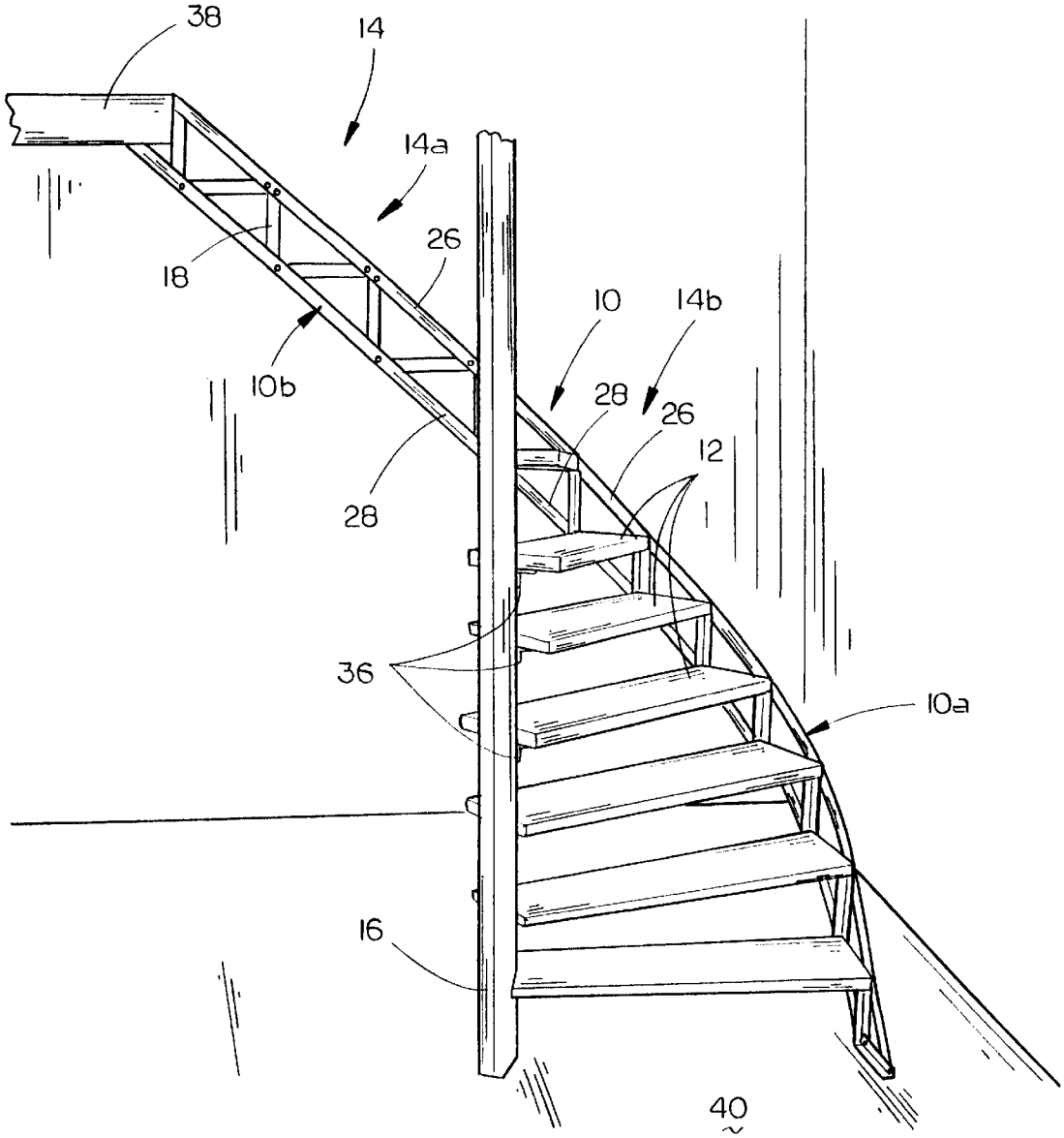
FIG. 1 is a perspective view of a combination staircase with curved and straight portions, using the stair frame of the present invention.

Referring now to the drawings, in which similar or corresponding parts are identified with the same reference numeral, and more particularly to FIG. 1, the stair frame of the present invention is designated generally at 10 and is shown supporting a plurality of treads 12 to form a staircase 14 having an upper straight section 14*a* and a lower spiral portion 14*b*.

Staircase spiral portion 14*b* has treads 12 which extend from a central post or newell 16 outwardly to a first stair frame 10*a*. Treads on the staircase straight portion 14*a* extend between stair frame 10*a* and a second stair frame 10*b*.

Figure 2:
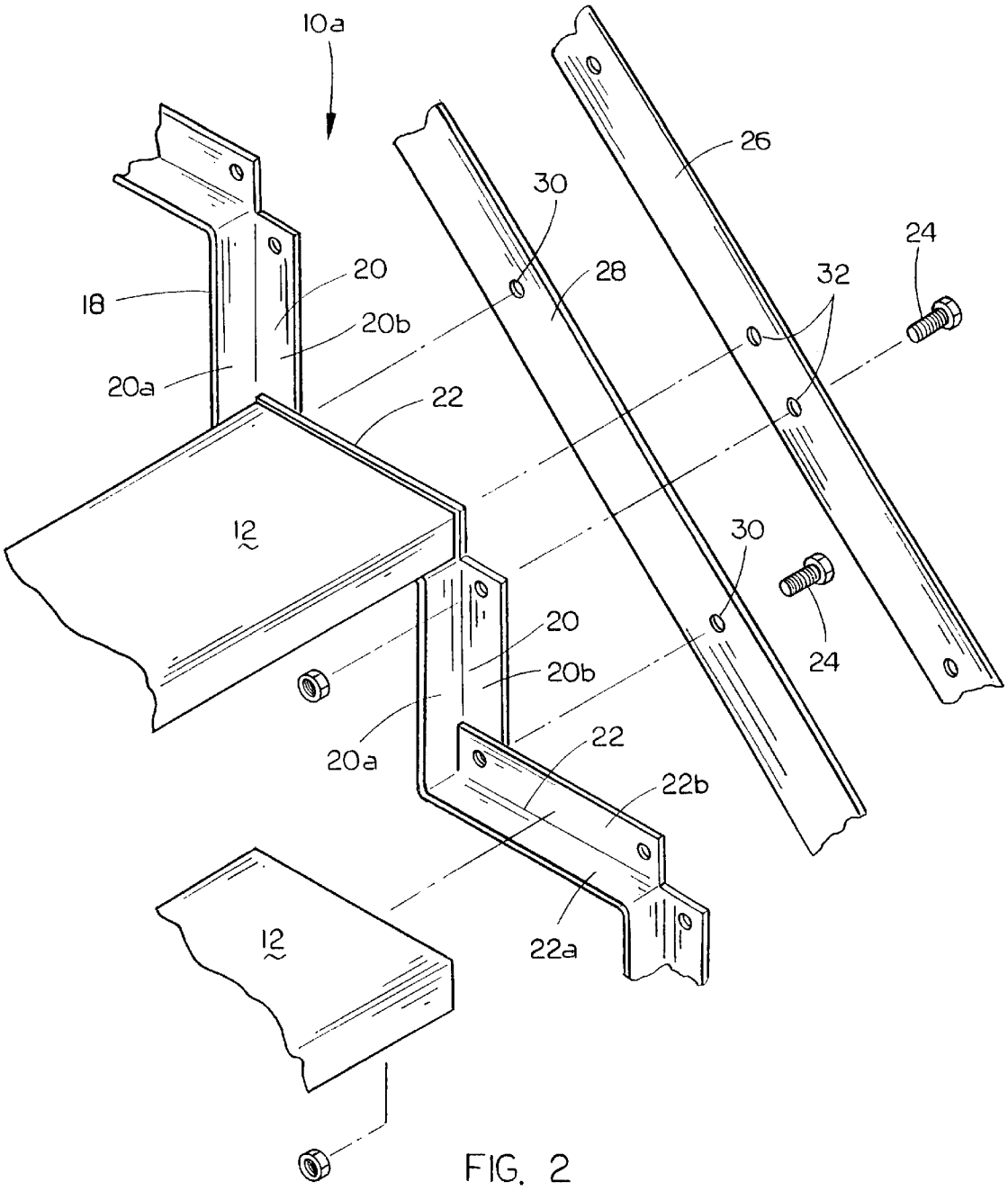
FIG. 2 is an enlarged exploded perspective view of a portion of the stair frame of the present invention.

Referring now to FIG. 2, stair frame 10*a* is shown in more detail. Stair frame 10*a* includes a zigzag or stair step shaped support rail 18 which is bent into vertical portions 20 and horizontal portions 22. Each of the vertical portions includes an elongated leg 20*a* connected orthogonally along its length to a back 20*b*. Similarly, each horizontal portion 22 includes an elongated leg connected orthogonally along its length to a back 22*b*. Each horizontal leg 22*a* is connected at its opposing ends to the next adjacent vertical leg 20*a*.

The upper and lower ends of each vertical portion back 20*b* has apertures formed therethrough for receiving a bolt 24, as described in more detail hereinbelow. Similarly, each of the forward and rearward ends of the horizontal portion backs 22*b* have apertures formed therethrough for receiving a bolt 24. The lower aperture in the vertical portion back 20*b* will align with the rearward aperture of the horizontal portion back 22*b*, to permit bolt 24 to be secured through both apertures.

A pair of upper and lower rails 26 and 28 are secured to the apertures in the vertical and horizontal portion backs 20*b* and 22*b*. Lower rail 28 has a plurality of spaced apart apertures 30 which will align with the aligned apertures of the vertical portion back 20*b* and horizontal portion back 22*b*, at the rearward edge of each tread 12. Similarly, upper rail 26 has a plurality of pairs of apertures 32 which will align with the forward aperture of the horizontal portion back 22*b* and the upper aperture of the vertical portion back 20*b* respectively, located generally proximal to the forward edge of each tread 12. Each tread 12 will then rest upon the leg 22*a* of each horizontal portion 22. As shown in FIG. 2, upper and lower rails 26 and 28 may each consist of elongated plates.

Figure 3:
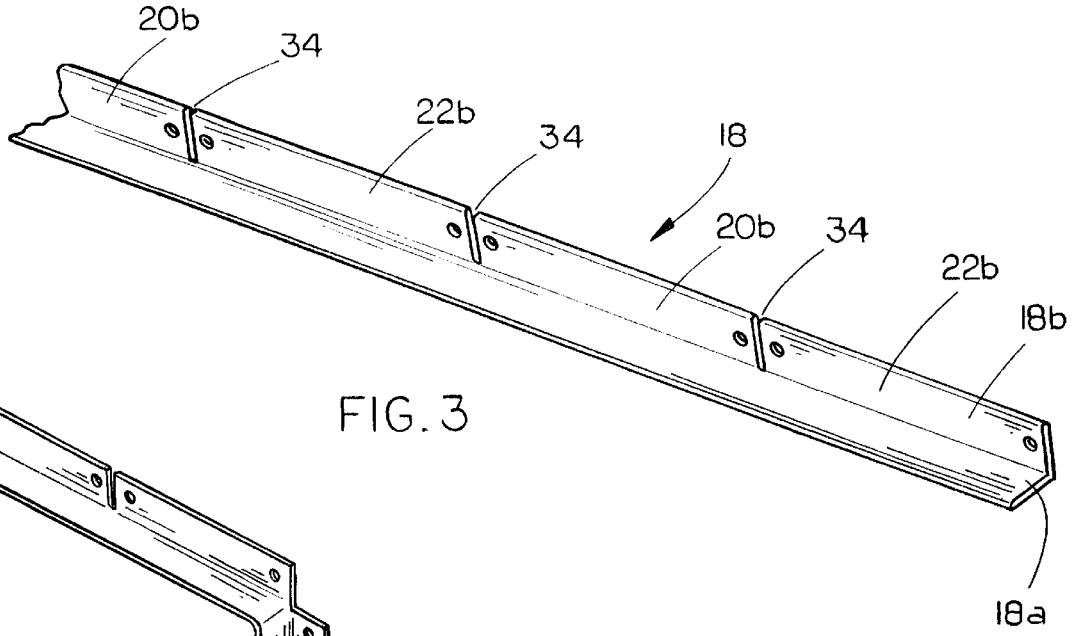
FIG. 3 is a perspective view of the support rail of the stair frame of the present invention, prior to being formed into the stair frame.
Figure 4:
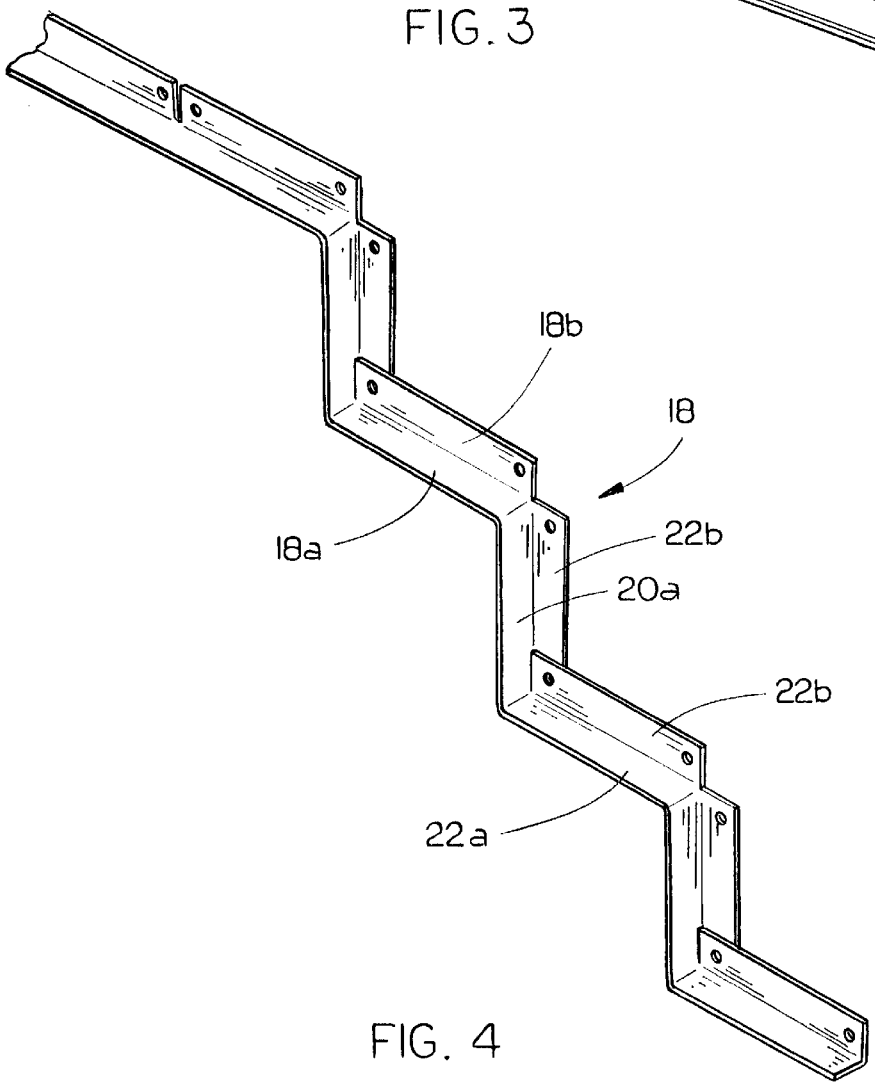
FIG. 4 is a perspective view of the support rail of the stair frame bent into a stair step configuration before attachment of the securement rail thereto.

Referring now to FIGS. 3 and 4, the support rail 18 is formed from an elongated length of angle iron having a leg portion 18*a* and a back portion 18*b*. A plurality of cuts 34 are made through the entire depth of the back portion 18*b* to form a plurality of separated back portions which will form the alternating vertical backs 20*b* and horizontal backs 22*b*. Apertures are then formed through each back portion 22*b* and 20*b*, adjacent the cuts 34.

Once cuts 34 have been made in the back 18*b* of rail 18, the leg portion 18*a* of rail 18 may be bent into the zigzag stair step pattern shown in FIG. 4. Upper and lower rails 26 and 28 are then affixed to the backs 20*b* and 22*b* of the vertical and horizontal portions 20 and 22, respectively, as shown in FIG. 2.

The use of a zigzag shaped support rail 18 enables the user to bend the stair frame 10*a* around a curve to form the stringer of a spiral staircase 14*b*. In the alternative, the support rail 18 can also be used as a stringer on a straight staircase 14*a*. Securement of the upper and lower rails 26 and 28 to the support rail 18 forms a plurality of lightweight triangular shapes which are interconnected to form a very strong frame.

When stair frame 10*a* is utilized for a spiral staircase 14*b*, a plurality of brackets 36 are secured between newell 16 and one end of stair treads 12 to support treads 12. The opposing ends of the treads 12 are supported on the horizontal leg portions of stair frame 10*a*.

The straight section 14*a* of staircase 14 has the upper ends of stair frames 10*a* and 10*b* secured to the upper level floor structure 38. The lower end of stair frame 10*a* is secured to the lower level floor 40, while the lower end of stair frame 10*b* is secured to newell 16.

Figure 6:
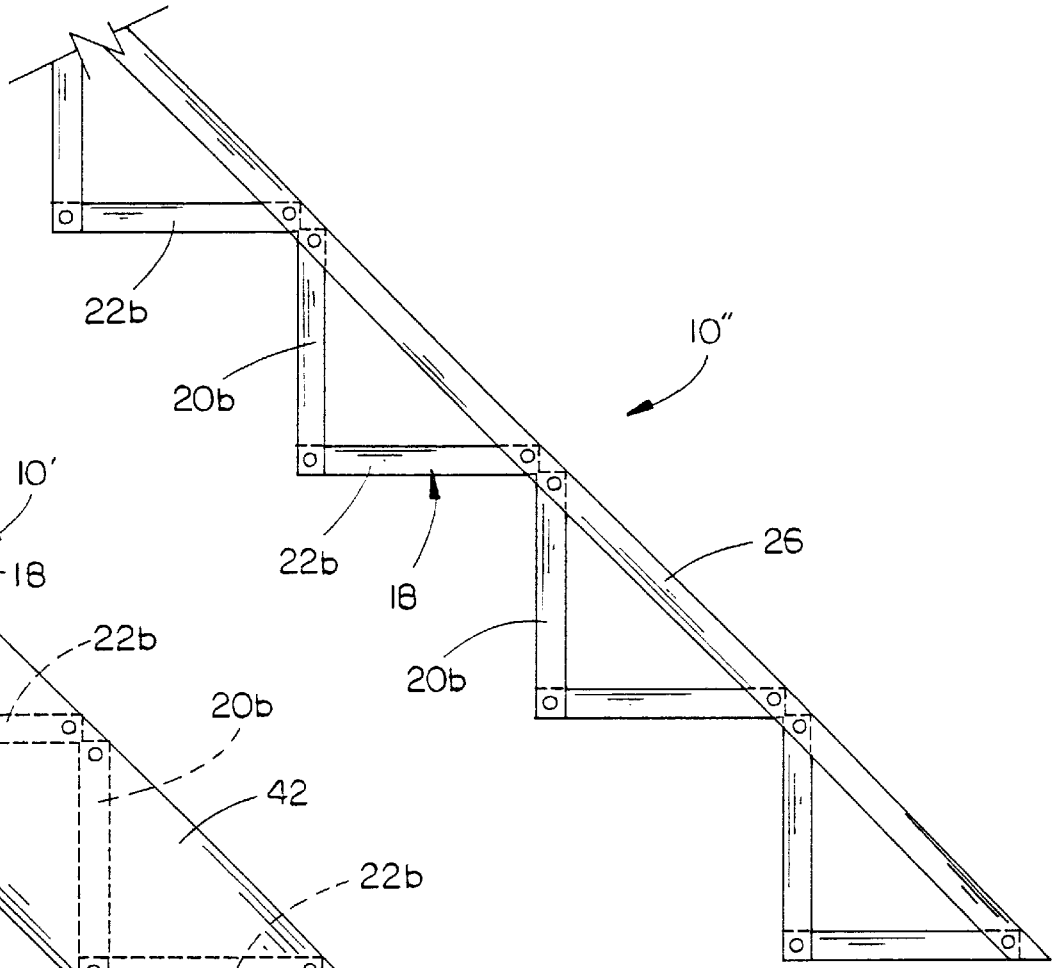
FIG. 6 is a side elevational view of a third embodiment of the stair frame.
Figure 5:
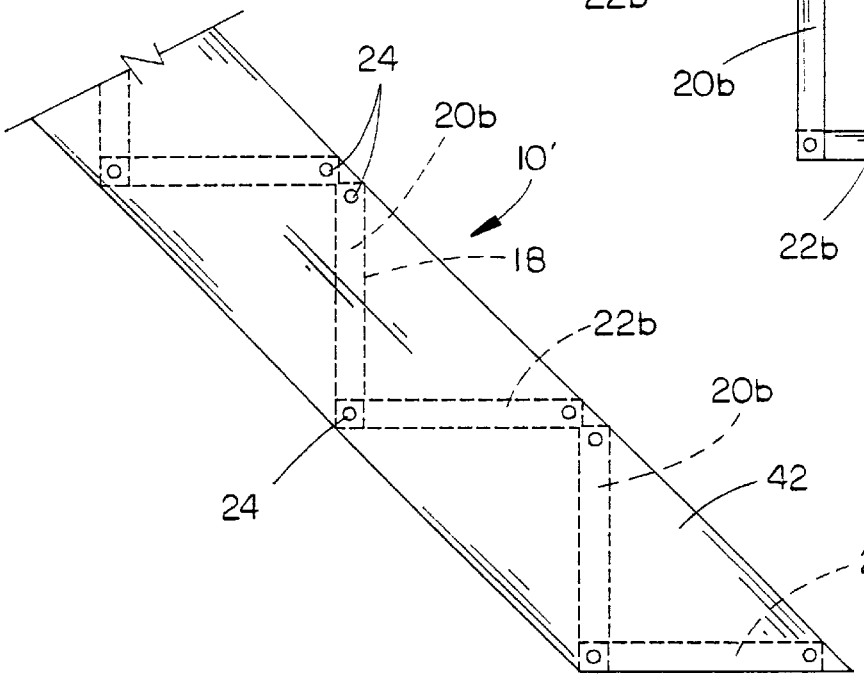
FIG. 5 is a side elevational view of a second embodiment of the stair frame.

Referring now to FIGS. 5 and 6, to different embodiments of the stair frame are shown. In FIG. 5, stair frame 10' includes the identical zigzag shaped support rail 18, but the upper and lower rails of the first embodiment are replaced with a solid panel 42. Bolts 24 are then secured through apertures in panel 42 to interconnect vertical back portions 20*b* and horizontal back portions 22*b* to panel 42.

The third embodiment of the stair frame 10" is shown in FIG. 6, and simply utilizes only upper rail 26 to interconnect the upper ends of vertical portion backs 20*b* and the forward ends of horizontal portion backs 22*b* of support rail 18.

Figure 7:
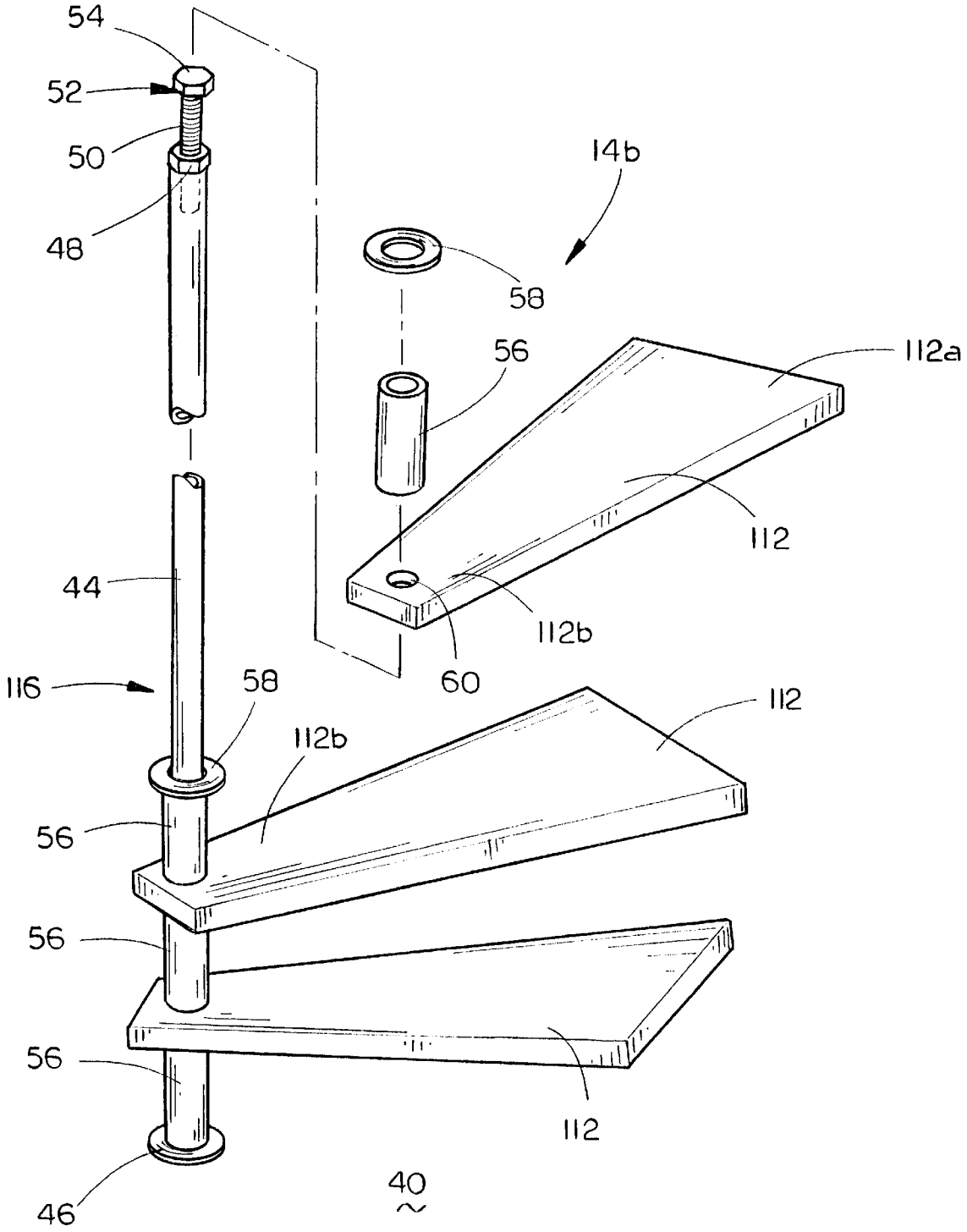
FIG. 7 is an exploded perspective view of a second embodiment of a newell post for the stair frame.

Referring now to FIG. 7, a second embodiment of the newell 116 and treads 112 is disclosed. Any of the three embodiments of the stair frame 10, 10' and 10" may be used to support the outward ends 112*a* of treads 112. The inward ends 112*b* of treads 112 are supported on newell 116, on the spiral section 14*b* of staircase 14, as described in more detail hereinbelow.

Newell 116 includes an elongated core pipe 44 with a base washer 46 mounted on the lower end for supporting the pipe 44 on the floor 40. The upper end has a nut 48 mounted thereon through which the shank 50 of a bolt 52 is threaded. The bolt head 54 may be vertically adjusted by rotation of bolt 52 in nut 48. In this way, bolt 52 may be extended against a ceiling, to hold newell 116 in the desired location.

A plurality of spacer sleeves 56 and washers 58 are provided to separate each tread 112. Each sleeve 56 and washer 58 has an inner diameter greater than the outer diameter of core pipe 44, to slide over and down pipe 44. An aperture 60 through the inward end 112*b* of each tread is sized to slide over the spacer sleeves, and rest on the washer 58.

Whereas the invention has been shown and described in connection with the preferred embodiment thereof, many modifications, substitutions and additions may be made which are within the intended broad scope of the appended claims.

I claim:

1. A staircase, comprising:

a spiral portion having a central newell post and a plurality of vertically spaced radially extending treads having first ends connected to the newell post; and said spiral portion treads having second ends supported on a generally helical shaped portion of a first stair frame;

said first stair frame comprising:

an elongated angle member having a continuous leg connected to an orthogonal back, said back cut into a plurality of independent back portions;

said angle member formed into a zigzag shape with a plurality of alternating vertical leg portions and horizontal leg portions; and a first rail extending the length of the zigzag shape and connected to an upper end of each vertical portion back, and connected to a forward end of each horizontal portion back.

2. The staircase of claim 1, wherein the spiral portion tread second ends are supported on the horizontal leg portions of the first frame.

3. The staircase of claim 2, further comprising a second rail extending the length of the zigzag shape and connected to a lower end of each vertical portion back, and connected to a rearward end of each horizontal portion back.

4. The staircase of claim 3, wherein the second rail is parallel to the first rail.

5. The staircase of claim 2, wherein the rail is a second plate and is further connected to a lower end of each vertical portion back, and to a rearward end of each horizontal portion back.

6. The staircase of claim 1, wherein said newell post includes a length adjustable upper end, for selectively retaining the post between a ceiling and floor.

7. The staircase of claim 1, wherein said newell post includes:

an elongated core pipe extending vertically; and a plurality of equal-length spacer sleeves slidably mounted on the core pipe, each sleeve having upper and lower ends;

each spiral portion tread first end being supported on the upper end of the a spacer sleeve.

8. The staircase of claim 7, wherein each spiral portion tread has an aperture formed vertically through the first end, said core pipe journaled through the apertures to retain the treads thereon.

9. The staircase of claim 1, further comprising a second rail extending the length of the zigzag shape, and connected to a lower end of each vertical portion back, and connected to a rearward end of each horizontal portion back.

10. The staircase of claim 1, wherein the rail is a plate and is further connected to a lower end of each vertical portion back, and to a rearward end of each horizontal portion back.

11. The staircase of claim 1, further comprising a straight portion extending from the spiral portion, said straight portion including:

said first stair frame extending along and supporting second ends of a plurality of straight portion treads;

a second stair frame extending from the newell post and parallel to the first frame, and supporting first ends of the straight portion treads;

said second stair frame comprising:

an elongated angle member having a continuous leg connected to an orthogonal back, said back cut into a plurality of independent back portions;

said angle leg formed into a zigzag shape with a plurality of alternating vertical leg portions and horizontal leg portions parallel to the vertical and horizontal leg portions of the first stair frame angle; and a rail extending the length of the second stair frame angle, and connected to an upper end of each second stair frame angle vertical portion back, and connected to a forward end of each second stair frame angle horizontal portion back.

12. A stair frame for supporting the ends of a plurality of stair treads, comprising:

an elongated angle member having a continuous leg connected to an orthogonal back, said back cut into a plurality of independent back portions;

said angle leg formed into a zigzag shape with a plurality of alternating vertical leg portions and horizontal leg portions; and a rail extending the length of the zigzag shape, and connected to an upper end of each vertical portion back, and connected to a forward end of each horizontal portion back.

13. The stair frame of claim 12, wherein said zigzag shape and rail are formed in a generally helical shape.

14. A method for forming a stair frame, comprising the steps of:

providing an elongated angle member having a leg connected orthogonally along its length to a back;

cutting a plurality of slots through the back to form a plurality of independent back portions;

bending the leg at each slot to form a zigzag shape with alternating vertical and horizontal leg portions, each leg portion having an associated orthogonal back portion; and securing a rail along the entire length of the angle, member with an upper end of each vertical portion back and a forward end of each horizontal portion back secured to the rail to form a frame.

15. The method of claim 14, further comprising the steps of:

securing a newell post in a vertical orientation;

bending at least a portion of the stair frame into a helical shape with the newell post forming the center of the helix; and securing a first end of each of a plurality of treads to the newell post, and a second end of each tread to a horizontal leg portion of the stair frame.

* * * * *